US005245773A

United States Patent [19]

Snyder

[11] Patent Number: 5,245,773

[45] Date of Patent: Sep. 21, 1993

[54] FLEXIBLE FACE SIGN

[75] Inventor: Delbert W. Snyder, Salem, Ohio

[73] Assignee: Sign Strut Ltd., Dublin, Ohio

[21] Appl. No.: 699,342

[22] Filed: May 13, 1991

[51] Int. Cl.[5] ..... G09F 17/00

[52] U.S. Cl. ..... 40/603; 38/102.91

[58] Field of Search ..... 40/603, 156, 157; 248/101; 160/392, 395, 327, 371; 38/102.91

[56] References Cited

U.S. PATENT DOCUMENTS

| | | | |
|---|---|---|---|
| 4,430,819 | 2/1984 | Chandler | 40/603 X |
| 4,441,269 | 4/1984 | Dahl | 40/603 X |
| 4,554,754 | 11/1985 | Stilling | 40/603 |
| 4,674,214 | 6/1987 | Gandy | 40/156 X |
| 4,817,317 | 4/1989 | Kovalak, Jr. | 40/603 |
| 5,033,216 | 7/1991 | Gandy et al. | 40/603 |

FOREIGN PATENT DOCUMENTS

| | | | |
|---|---|---|---|
| 268308 | 5/1988 | European Pat. Off. | 40/603 |

*Primary Examiner*—Kenneth J. Dorner
*Assistant Examiner*—J. Bonifanti
*Attorney, Agent, or Firm*—Colucci & Umans

[57] ABSTRACT

A double face sign utilizes flexible sign face material which is tensioned to a sufficiently high degree of absorb all loads anticipated for the sign. A relatively light weight and weak cover frame is provided to which the sign face is pretensioned. The more rigid and strong main frame of the sign carries a tensioning edge which extends outwardly of a face plane of the main frame. The cover frame is bolted against the face plane of the main frame to press the inner surface of the sign face against the tensioning edge, to complete tensioning of the sign face material. The final tensioning force is absorbed by the strong main frame by its attachments to the cover frame.

15 Claims, 2 Drawing Sheets

FLEXIBLE FACE SIGN

FIELD AND BACKGROUND OF THE INVENTION

The present invention relates in general to sign constructions, and in particular to a new and useful single or multiple face sign which utilizes flexible sign face material.

A wide variety of tensioning system for flexible sign face is known. See for example U.S. Pat. No. 3,885,335 to Egermayer which shows a double face sign having flexible face material and edge systems for tensioning the material. A back lighted sign using flexible material is also disclosed in U.S. Pat. No. 4,185,408 to Tracy. A sign having a flexible sheet material stretched on a heavy duty frame which is hinged to a sign box is disclosed in U.S. Pat. No. 4,516,343 to Stilling.

Flexible double face signs on the order of eight feet square and smaller are not economically feasible when compared to double face rigid acrylic signs common in the industry today.

Flexible double face signs with lighted graphics or displays on opposite sides require a stronger frame than rigid acrylic double face signs. Tensioning of the flexible vinyl creates a stress load of 30 lbs per square foot (pfs) that must be resisted by the frame. The flexible vinyl also transmits wind loads to the frame in a different manner than rigid acrylic, again requiring additional frame strength. Adding strength to the frame creates an exponential increase in cost and weight. The cost vs. strength equation has created an economic barrier in the sign industry which no one has been able to overcome.

In addition, one or both sign faces in a double face sign must be hinged to open and provide access to the interior of the sign for lamp and ballast maintenance. A rigid frame around the perimeter of the flexible sign face must be strong enough to resist tensioning and wind loads.

SUMMARY OF THE INVENTION

The present invention provides a sign with a low strength, light weight cover frame in combination with a stronger main sign frame which is comparably priced and stronger than rigid acrylic signs.

The frame of the invention is required only to hold the flexible sign face. Tension is completed only when the hinged or removable cover frame of the sign is closed and secured to the main sign frame. The main sign frame is inherently strong enough to resist all loads involved.

By combining a low strength, light weight cover frame with a rigid and strong main side frame, and an appropriate apparatus to tension the flexible sign face when the two frames are fixed to each other, the invention provides a relatively large flexible sign face with no seams. In addition, the sign face may be selected to match the color scheme, designs and texture of other flexible face signs used at a particular installation, for example, a gas station or convenience store. Accordingly, an object of the present invention is to provide a sign comprising, a rigid main frame having at least one face plane, a tension edge member connected to the rigid frame and having a tensioning edge extending parallel to the plane, a removable cover frame detachably connected to said main frame at said plane, at a location outwardly spaced from said tensioning edge, a flexible sign face for carrying a sign display and having a plurality of outer edges, preliminary tensioning means connected between the sign face edges and the cover frame for pretensioning the sign face on the cover frame, and final tensioning means connected between the cover frame and the main frame for urging the cover frame toward the plane of the main frame to press the flexible sign face against the tensioning edge to complete tensioning of the flexible sign face.

Another object of the present invention is to provide a sign which utilizes flexible face material and which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which the preferred embodiments of the invention are illustrated.

DESCRIPTION OF THE PREFERRED EMBODIMENT

Figure 2:
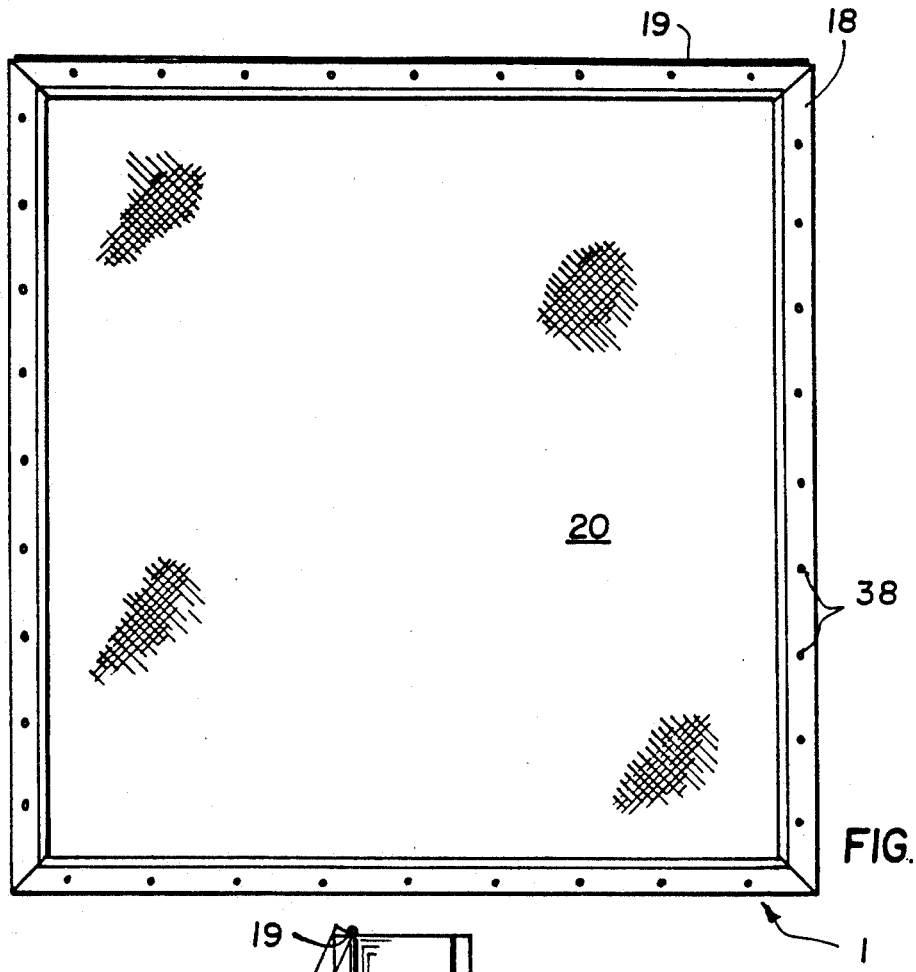
FIG. 2 is a front elevational view of the sign shown in FIG. 1.
Figure 1:
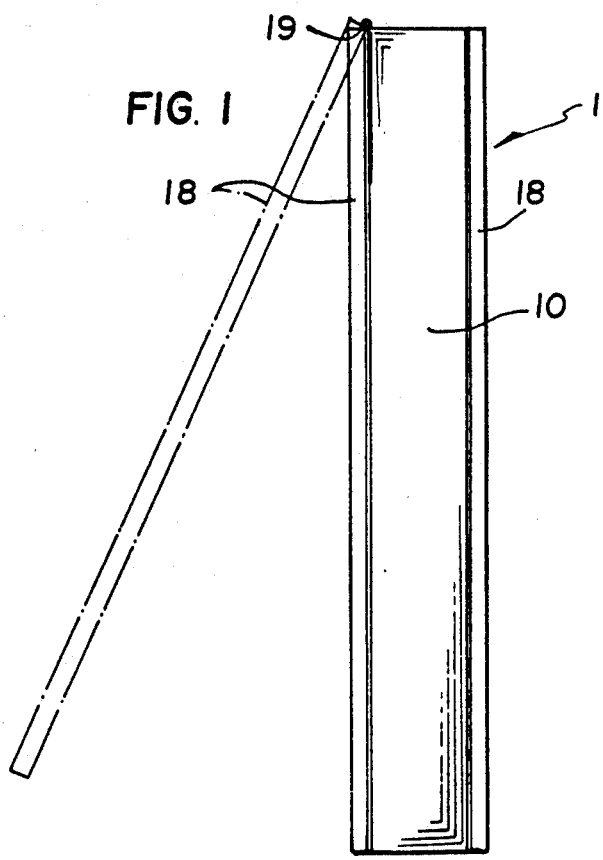
FIG. 1 is a side elevational view of a double face sign incorporating the present invention.

Referring to the drawings in particular, the invention embodied in FIGS. 1 and 2 is a double face sign generally designated 1 having a strong rigid main frame or sign box 10 which contains all appropriate ballasts, lighting tubes and structures for illuminating the opposite faces of the sign. The flexible sign face 20 carries all graphics, displays and indicia, and is illuminated from behind by the light fixtures in main frame 10. Although advantageously, two flexible sign faces are provided on opposite sides of the main frame 10, for the purposes of the present disclosure, only one of these sign faces will be discussed. The other may be identical or similar.

Flexible sign face 20 is carried on a relatively light weight cover frame 18 which is shown in its closed solid line position in FIG. 1, and an open phantom line position. Cover frame 18 is advantageously hinged at a hinge 19, to the top of main frame 10. Alternatively, the cover frame may be removably mounted to the main frame 10.

Figure 3:
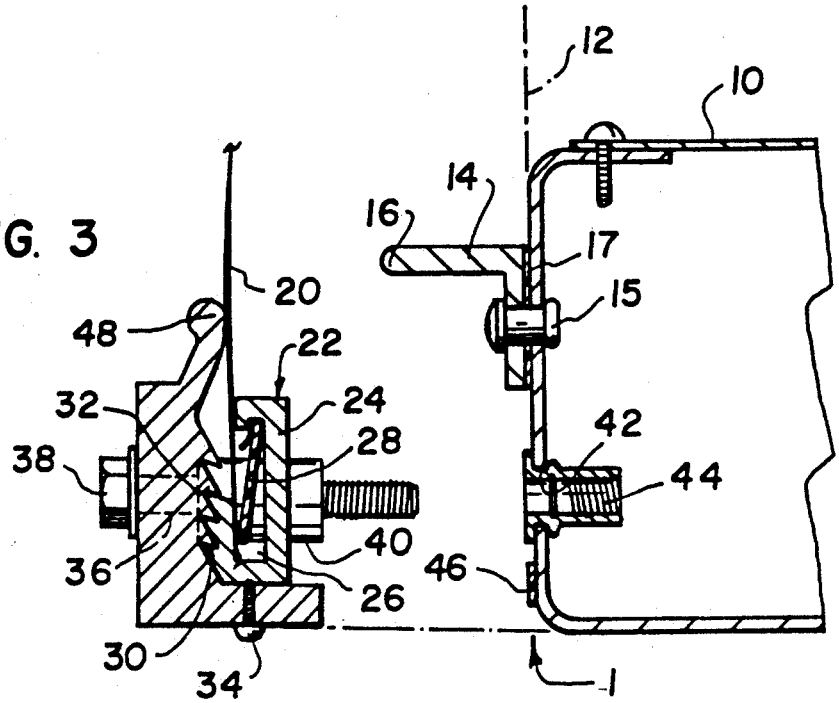
FIG. 3 is a side sectional view of the apparatus for pretensioning and final tensioning of the flexible sign face according to the present invention, in an open position.

FIG. 3 is a sectional view of a front lower portion of the sign in its open condition. Main frame 10 has a face plane 12 which is parallel to the final display plane of the flexible sign face 20 when the frame is closed. A tension edge member 14 in the form of an aluminum angle iron or similar structure, is attached to the main frame 10 by a rivet or other means 15, at the face plane 12. A foam gasket 17 is provided between one leg of tension member 14 and the face plane 12 of the frame 10. The other leg of member 14 carries a tensioning edge 16 which extends parallel to the face plane 12. Frame 10 includes four sides which form the rectangular or square frame. A tension member 14 with edge 16 is advantageously provided on each side of the frame. Alternatively, however, two opposite tension members may be provided on opposite sides of the frame or even a single tension member may be utilized opposite the hinge to satisfactorily tension the flexible face. A preferred embodiment of the invention however, includes four tensioning edges 16 in a rectangular or square configuration.

In constructing the sign, outer edges of the flexible sign face 20 are first pretensioned to the cover frame 18 by preliminary tension means 22. This may be of the type disclosed in U.S. Pat. No. 4,955,928, entitled TENSIONING CONNECTOR FOR RETAINING SIGN MEMBRANES, assigned to the assignee of the present application. Other preliminary tensioning means may be provided, however. The only requirement is that the flexible face 20 be pretensioned across the cover frame 18 to avoid wrinkles and somewhat support the flexible face in a planar configuration. Pretensioning must not be particularly strong however, because of the light weight construction of cover frame 18.

Figure 4:
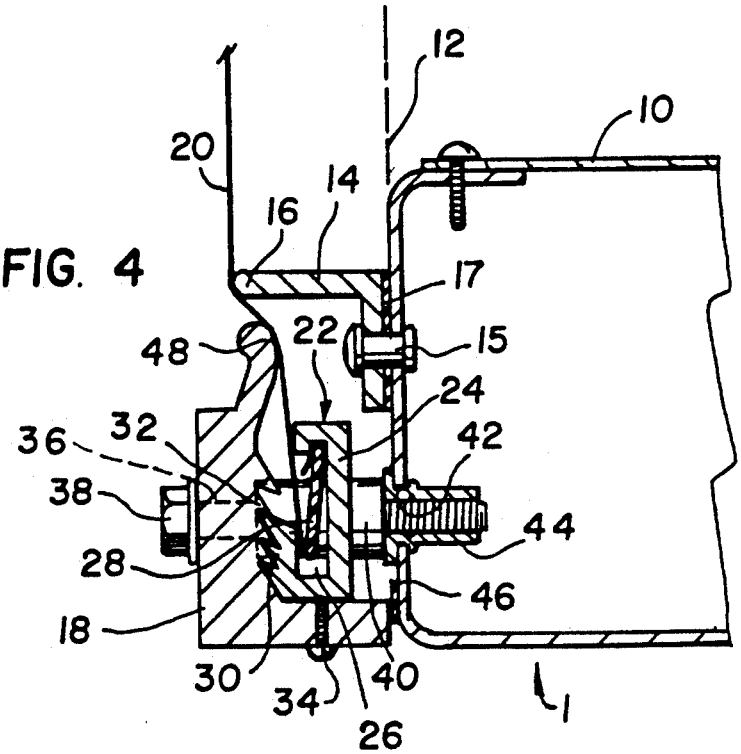
FIG. 4 is a view similar to FIG. 3 of the invention in a closed position.

The preliminary tensioning means 22 shown in FIGS. 3 and 4 comprises a click member 24 containing an open channel 26 extending along the side of cover frame 18. A plastic binder 28 is wedged into channel 26 by the outer edge area of flexible face 20 which is partly wrapped around the binder 28.

An outer surface of click member 24 carries teeth 30 which are inclined outwardly with respect to the sign face 20 and toward the main frame 10. These teeth mesh with teeth 32 defined on the inner surface of the cover frame 18. By moving the click member 24 outwardly on the cover frame 18, a meshing engagement between selected teeth on the two members is established to pretension the flexible face 20. To maintain the position of click member 24, a set screw 34 screwed into the outer edge of frame 18 is turned to press inwardly against the click member 24 and hold it in position.

Frame 18 is also provided with a plurality of bores 36 which are spaced at intervals around the frame. Each bore receives a bolt 38 which extends toward the main frame 10. A spacer in the form of a plastic or aluminum spool 40 is engaged around the bolt 38 to maintain a desired spacing between the frame 18 and frame 10 when the two frames are engaged with each other.

At spaced locations corresponding to the locations of bores 36, frame 10 includes its own set of bores 42 which each contain a threaded insert 44 having female threads which match the male threads of bolt 38.

An additional foam gasket 46 is engaged around frame 10 outwardly of the bores 42. The preliminary tensioning means 22 is also positioned on the cover frame 18 in a position that is outwardly of the tension member 14, when the cover frame is engaged to the main frame.

Cover frame 18 also includes a second tensioning edge 48 which extends inwardly of the frame but which is still positioned outwardly of the first tensioning edge 16 when the cover frame is engaged to the main frame.

To complete the tensioning of flexible face 20, the cover frame 18 is fully engaged to the main frame 10 and urged toward the face plane 12 in a manner shown in FIG. 4.

For this purpose, the detached or hinged cover frame 18 is pushed toward the face plane 12 and the bolts 38 are screwed into their respective inserts 44. In the final closed position as shown in FIG. 4, the inner surface of sign face 20 is urged against the first tensioning edge 16. This causes the material of sign face to be moved outwardly with respect to the frame 18, and thus, at a close outwardly positioned location with respect to edge 16, the material of sign face 20 is pressed against the second edge 48. This S-shaped configuration for the edge area of sign face 20 completes the tensioning which is transmitted to the stronger main frame 10 by the bolts 38. For this reason, cover frame 18 may be made of light and relatively weak construction.

For the same reason, the completely tensioned sign face 20 in the sign construction 1 is capable of withstanding 70 psf. This far exceeds the maximum required 55 psf for double face signs using flexible sign faces, and is far in excess of the 35 psf which is the maximum force rating on acrylic signs.

To exclude water from inside the main frame 10, gaskets 17 and 46 are provided, between the cover frame and the main frame 10. Spacer 40 maintains a correct spacing to avoid over crushing the gaskets.

Alternate embodiments of the invention position the second tensioning edge 48 inside the first tensioning edge 16 to achieve complete tensioning of the flexible sign face 20. Pretensioning means 22 may also be replaced by a simpler apparatus. For example, the cover frame 18 may be formed of angles and the edge of flexible sign face 20 trapped to one leg of the angle by a plate riveted or otherwise connected to the leg of the angle. Shims can be used between the cover frame and the main frame to adjust the amount of tensioning of the flexible sign face. In a still further embodiment of the invention, complete tensioning is achieved without the use of any tensioning edge but simply by connecting the cover frame to the main frame through an inclined, wedged, cammed or rocker arrangement which tends to spread the frame as the frame is brought to the face plane of the main frame.

In addition to the comparable cost of the flexible sign of the present invention and the acrylic signs of the prior art, the present invention is far safer since when the acrylic sign blows out, the sharp jagged pieces of acrylic material represent a serious safety hazard.

While a specific embodiment of the invention has been shown and described in detail to illustrate the application of the principles of the invention, it will be understood that the invention may be embodied otherwise without departing from such principles.

What is claimed is:

1. A sign comprising:

a rigid main frame (10) having at least one face plane (12);

a removable cover frame (18) which is less rigid than said rigid main frame, detachably connected to said main frame at said plane;

a flexible sign face (20) for carrying a sign display and having a plurality of outer edges;

preliminary tensioning means (22) connected between the sign face edges and the cover frame for pre-tensioning the sign face on the cover frame; and final tensioning means connected between the cover frame and the main frame for rigidly attaching the cover frame to the main frame and for urging the cover frame toward the plane of the main frame to complete tensioning of the flexible sign face and for bracing the flexible sign face on the main frame.

2. A sign according claim 1, including a rigid tension edge member fixed to the rigid frame and having a tensioning edge extending parallel to and in front of the face plane, the removable cover frame being at a location outwardly spaced from said tensioning edge, said final tensioning means pressing the flexible sign face against the tensioning edge to complete tensioning of the flexible sign face.

3. A sign according to claim 2, wherein said cover frame includes a second tensioning edge positioned outwardly of the first mentioned tensioning edge and engageable against an opposite side of the flexible sign face from the first mentioned tensioning edge, for completing tensioning of the flexible sign face by engagement of the flexible sign face against the first mentioned and second tensioning edges.

4. A sign according to claim 2, wherein said cover frame is hinged to said main frame.

5. A sign according to claim 2, wherein said final tensioning means comprises a plurality of connectors spaced around said cover frame and engagable with said rigid main frame.

6. A sign according to claim 1, wherein said preliminary tensioning means comprises a click member to which an outer edge of the flexible sign face is fixed, the click member having a plurality of inclined teeth, the cover frame having a second plurality of inclined teeth selectively meshed with the teeth of the click member for pretensioning the sign face to the cover frame.

7. A sign according to claim 6, wherein said cover frame includes a second tensioning edge positioned outwardly of the first mentioned tensioning edge and engageable against an opposite side of the flexible sign face from the first mentioned tensioning edge, for completing tensioning of the flexible sign face by engagement of the flexible sign face against the first mentioned and second tensioning edges.

8. A sign according to claim 7, wherein said cover frame is hinged to said main frame.

9. A sign according to claim 8, wherein said final tensioning means comprises a plurality of connectors spaced around said cover frame and engagable with said rigid main frame.

10. A sign according to claim 1, wherein said tensioning edge member comprises an angle iron having one leg fixed to the rigid frame at said plane, and a second leg carrying said tensioning edge.

11. A sign according to claim 10, including a gasket between the one leg of said angle iron and the main frame.

12. A sign according to claim 11, including a further gasket between the cover frame and the main frame positioned outwardly of the angle iron on the main frame.

13. A sign according to claim 12, wherein said final tensioning means comprises a plurality of connectors spaced around said cover frame and engagable with said rigid main frame.

14. A sign according to claim 13, wherein said connectors comprise bolts, said main frame including a plurality of threaded bores each for receiving one of said bolts, said bolts and threaded bores extending transversely to the face plane.

15. A sign according to claim 14, including a spacer engaged around each bolt between the cover frame and the main frame for maintaining a selected spacing between the cover frame and the main frame.

* * * * *